United States Patent [19]

Kemp, Jr. et al.

[11] Patent Number: 4,777,015

[45] Date of Patent: Oct. 11, 1988

[54] PROCESS FOR PRODUCING TUNGSTEN HEAVY ALLOY SHEET USING A METALLIC SALT BINDER SYSTEM

[75] Inventors: Preston B. Kemp, Jr., Athens; Walter A. Johnson, Towanda; James R. Spencer, Sayre, all of Pa.

[73] Assignee: GTE Products Corporation, Stamford, Conn.

[21] Appl. No.: 143,878

[22] Filed: Jan. 14, 1988

[51] Int. Cl.[4] ..... G22F 1/00

[52] U.S. Cl. ..... 419/32; 75/248; 419/31; 419/36; 419/40; 419/43; 419/47; 419/53; 419/54; 419/57; 419/58

[58] Field of Search ..... 75/248; 419/36, 40, 419/47, 43, 31, 32, 53, 54, 57, 58

[56] References Cited

U.S. PATENT DOCUMENTS

| | | | |
|---|---|---|---|
| 3,658,517 | 4/1972 | Davies et al. | 419/36 |
| 3,890,145 | 6/1975 | Hivert et al. | 419/36 |
| 4,605,599 | 8/1986 | Penrice et al. | 75/248 |
| 4,698,096 | 10/1987 | Schmidberger et al. | 75/248 |
| 4,721,599 | 1/1988 | Nakamura | 419/23 |

*Primary Examiner*—Stephen J. Lechert, Jr.
*Attorney, Agent, or Firm*—Donald R. Castle; L. Rita Quatrini

[57] ABSTRACT

A process is disclosed for producing a sheet of tungsten heavy alloy which involves uniformly blending metal powder compnents of the alloy by forming a slurry of the powder components and one or more chemical compounds of at least one of the components of the alloy as an inorganic binder in a liquid medium, the chemical compound being soluble in the liquid medium and capable of being decoposed into one or more of the metal components of the alloy below the melting point of the metal powder components, removing the liquid medium from the powder components and forming a planar cake of the powder components and said inorganic binder, drying the cake, heating the cake to a temperature sufficient to decompose the inroganic binders into their elemental components or oxides, followed by heating the cake in a reducing atmosphere at a temperature sufficient to reduce any oxides forming during the previous steps to the metals, and sintering the cake to a density equal to or greater than about 90% of the theoretical density of the alloy to form the sheet.

3 Claims, No Drawings

PROCESS FOR PRODUCING TUNGSTEN HEAVY ALLOY SHEET USING A METALLIC SALT BINDER SYSTEM

CROSS REFERENCE TO RELATED APPLICATIONS

This invention is related to the following applications: attorney's docket D-87-2-052, entitled "Process For Producing Tungsten Heavy Alloy Sheet", Ser. No. 143,866, D-87-2-054 entitled "Process For Producing Tungsten Heavy Alloy Sheet Using Hydrometallurgically Produced Tungsten Heavy Alloy", Ser. No. 143,864, D-87-2-176 entitled "Process For Producing Tungsten Heavy Alloy Sheet By Direct Hydrometallurgical Process", Ser. No. 143,875, D-87-2-055 entitled "Process For Producing Tungsten Heavy Alloy Sheet Using High Temperature Processing Techniques", Ser. No. 143,869, and D-87-2-196 entitled "Process For Producing Tungsten Heavy Alloy Sheet By A Loose Fill Hydrometallurgical Process", Ser. No. 143,865, all of which are filed concurrently herewith and all of which are assigned to the same assignee as the present application.

This invention relates to a process for producing tungsten heavy alloy sheet in which a preform cake is first formed which is substantially close in thickness to the final thickness of the rolled sheet.

BACKGROUND OF THE INVENTION

Tungsten heavy alloy sheet can be produced by rolling sintered slabs of the alloy. Because the rolling requires numerous anneals, it is desirable that the starting slab be no more than about twice the final thickness. One method to produce these slabs is by isostatically pressing the powder alloy blends and sintering them to full density. With thin slabs, it is difficult to get a uniform fill of the mold so the resulting slabs are not uniform in thickness. There is also a problem with breakage with the thin slabs. Using this method it is not possible to produce slabs with a surface area to thickness ratio much over 600 or thickness less than about 0.5".

Another method of making tungsten heavy alloy sheet is to press large billets and cut the green billets into thin slabs. While this process produces slabs of uniform thickness it has the size limitations of the previous method and there is the added expense of cutting.

It would be desirable to make a sheet preform substantially close in thickess to the final thickness of the rolled sheet. This would reduce the time, energy, and labor required for hot rolling and annealing.

SUMMARY OF THE INVENTION

In accordance with one aspect of this invention, there is provided a process for producing a sheet of tungsten heavy alloy which involves uniformly blending metal powder components of the alloy by forming a slurry of the powder components and one or more chemical compounds of at least one of the components of the alloy as an inorganic binder in a liquid medium, the chemical compound being soluble in the liquid medium and capable of being decomposed into one or more of the metal components of the alloy below the melting point of the metal powder components, removing the liquid medium from the powder components and forming a planar cake of the powder components and said inorganic binder, drying the cake, heating the cake to a temperature sufficient to decompose the inorganic binders into their elemental components or oxides, followed by heating the cake in a reducing atmosphere at a temperature sufficient to reduce any oxides formed during the previous steps to the metals, and sintering the cake to a density equal to or greater than about 90% of the theoretical density of the alloy to form the sheet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The process of the present invention relates to formation of a planar cake of the component powders of the tungsten heavy alloy. This cake can then be processed to form a sheet which is substantially close in thickness to the final thickness of the rolled sheet. As a result of formation of this type of cake, there is a reduction in the time, energy and labor required for hot rolling and annealing.

Some tungsten heavy alloys which are especially suited to this invention are tungsten-iron-nickel alloys, especially those in which the Ni:Fe weight ratio is from about 1:1 to about 9:1 and most preferably about 8:2. As an example of these preferred alloys are those having the following compositions in percent by weight: about 8% Ni, about 2% Fe, and the balance W, about 4% Ni, about 1% Fe, and the balance W, and about 5.6% Ni about 1.4% Fe, and the balance W. The alloys can be with or without additions of Cu and/or Co.

The elemental metal powder components of the alloy are first uniformly blended. This is done by forming a slurry of the powders in a liquid medium. The liquid medium can be water or a non-aqueous solvent. Typical non-aqueous solvents are alcohol, one in particular being reagent alcohol which is about 90% by weight ethyl alcohol, about 5% by weight methyl alcohol, and about 5% by weight isopropyl alcohol. Also added to and made part of the slurry is a chemical compound of at least one of the components of the alloy which serves as an inorganic binder or binders. The chemical compound must be soluble in the liquid medium and be capable of being decomposed below the melting point of the metal powder components into the element or elements of the alloy. In accordance with a preferred embodiment, the chemical compounds can be one or more of those of tungsten, iron and nickel. Preferred compounds salts which work especially well in the process of the present invention are ammonium paratungstate, ammonium metatungstate, iron chloride, nickel chloride, iron hydroxide, nickel hydroxide, iron oxalate, and nickel oxalate.

The actual formation of the slurry can be done by standard methods such as mixing and stirring the solids into the liquid medium with the amount of the liquid medium being sufficient to allow agitation of the slurry but not excessive so that the process becomes impractical.

The liquid medium is then removed from the powders. This is done in such a way so that the powders form into a planar cake which is substantially close in thickness to the thickness of the final rolled sheet. The thickness of the sheet is typically from about 0.1" to about 0.5" after sintering and before rolling. By a planar cake is meant that the cake is uniform in thickness and density and is uniform in composition across the length and width of the cake. At this point, the composition of the cake may not be uniform throughout the thickness because tungsten would tend to settle faster. However, during the subsequent sintering step, compositional variations essentially disappear and the composition becomes substantially uniform throughout its thickness. The preferred methods of forming the planar cake are by using a porous filter medium and applying vacuum, gas pressure, or mechanical pressure. Vibration can also be used if this is desirable. The liquid removal can be accomplished by batch or continuous processing.

As has been stated previously, the chemical compounds which serve as the inorganic binders are soluble in the slurry liquid medium. Therefore, when the metal solids are removed from the bulk of the slurry medium, a relatively small amount of the solution containing the dissolved binders remains on the metals. After the drying, the inorganic compound or compounds serve to bind the metal particles together. Since the amount of binder is relatively small, upon subsequent reduction of these binders to their metals, the composition of the alloy is not typically changed to any significant degree.

The resulting planar cake is then dried by conventional or modifications of conventional powder metal drying methods to remove essentially all the liquid therefrom. The methods are selected to reduce or eliminate cracking of the cake during drying.

The cake is heated in a non-oxidizing, that is a reducing or non-reacting atmosphere at a temperature sufficient to decompose the inorganic salts into their component elements or oxides. When the preferred chemical compounds of ammonium paratungstate and ammonium metatungstate are used, they are decomposed into tungsten. Because they contain no other contaminating elements, there is no residue left after the decomposition. This is an advantage over organic binders which leave an undesirable carbonaceous residue after the de-waxing step. When ammonium paratungstate and ammonium metatungstate are used as binders, they are decomposed at temperatures of from about 200° C. to about 800° C.

In actual practice the above described drying and heating steps can be done in one operation if this is convenient.

The resulting dried and heated cake is then reduced by heating in a reducing atmosphere such as hydrogen to insure the essentially complete reduction of any compounds or oxides which may have formed in the previous operations to the respective metals. The reduction is done below the normal sintering temperature of any metal contained therein. By "normal sintering temperature" is meant the temperature at which the cake is sintered to the final desired density. A minor amount of sintering can take place at this point and it is advantageous because it strengthens the cake and the cake is easier to handle if handling is necessary. This temperature is normally from about 800° C. to 1000° C. The time of heating depends on factors as the temperature, size of charge, thickness of the cake, nature of the equipment, etc.

The resulting dried and heated cake is then sintered by well known methods to a density at or near the theoretical density. This is considered to be equal to or greater than about 90% of the theoretical density of the alloy. Depending on the application and on the composition the cake can be solid state or liquid phase sintered to form the sheet. For example, if the sheet is to be rolled, it is necessary to get the density to at least about 90% to about 93% of the theoretical density. With a weight composition consisting essentially of about 7% Ni, about 3% Fe, and about 90% W, solid state sintering would be sufficient. Sintering temperatures and times depend on the nature of the alloy and on the density desired for the specific application. In the example above, the solid state sintering temperature is from about 1400° C. to about 1430° C. Liquid phase sintering is preferable for better rolling, higher density and healing of crack which can form during drying. Densities of about 99.4% of the theoretical have been achieved in practice. Usually liquid phase sintering results in a more uniform composition of the alloy components throughout the sheet. The liquid phase sintering temperature is above the solidus temperature of the matrix phase of the alloy but below the melting point of tungsten.

The resulting sheet can now be processed by known methods of hot rolling and annealing to form the final size sheet. However, when the process of the present invention is followed to produce the prerolled and preannealed sheet, less rolling and annealing are required than with sheets formed by prior art methods. This is because the cake has been formed to a size very close to the desired size of the final sheet.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) uniformly blending metal powder components of said alloy by forming a slurry of said powder components, one or more chemical compounds of at least one of said components of said alloy as an inorganic binder, in a liquid medium with said chemical compound being soluble in said liquid medium and capable of being decomposed into one or more of said metal components of said alloy below the melting point of said metal powder components;

(b) removing said liquid medium from said powder components and forming a planar cake of said powder components and said inorganic binder;

(c) drying said cake;

(d) heating said cake in a non-oxidizing atmosphere at a temperature sufficient to decompose said inorganic binders into their elemental components or oxides;

(e) heating the resulting first heated cake in a reducing atmosphere at a temperature sufficient to reduce any oxides formed during step a, b, c, and d to the metals;

(f) sintering the resulting reduced cake to a density equal to or greater than about 90% of the theoretical density of said alloy to form said sheet.

2. A process of claim 1 wherein said inorganic binders are selected from the group consisting of ammonium paratungstate and ammonium metatungstate, iron chloride, nickel chloride, iron hydroxide, nickel hydroxide, and iron oxalate, and nickel oxalate.

3. A process of claims 1 or 2 wherein said inorganic binders are selected from the group consisting of ammonium paratungstate and ammonium metatungstate.

* * * * *